US005813396A

United States Patent [19]

Bessette

[11] Patent Number: 5,813,396

[45] Date of Patent: Sep. 29, 1998

[54] RANGE GUARD APPARATUS AND METHOD

[76] Inventor: Raymond W. Bessette, 3360 NW. 22nd Pl., Coconut Creek, Fla. 33066

[21] Appl. No.: 742,100

[22] Filed: Oct. 31, 1996

Related U.S. Application Data

[63] Continuation-in-part of Ser. No. 22,370, May 4, 1994, which is a continuation of Ser. No. 948,993, Sep. 21, 1992, abandoned.

[51] Int. Cl.[6] ..... F24C 15/10

[52] U.S. Cl. ..... 126/214 D

[58] Field of Search ..... 126/214 D, 211

[56] References Cited

U.S. PATENT DOCUMENTS

| | | | |
|---|---|---|---|
| 4,157,705 | 6/1979 | Caan | 126/214 D |
| 4,836,181 | 6/1989 | Saga | 126/211 |
| 5,546,928 | 8/1996 | Lewis et al. | 126/214 D |

FOREIGN PATENT DOCUMENTS

| | | | |
|---|---|---|---|
| 3931521 | 11/1990 | Germany | 126/211 |
| 8801604 | 1/1990 | Netherlands | 126/211 |

*Primary Examiner*—Carroll B. Dority

[57] ABSTRACT

A range guard apparatus for preventing hot food splashes from injuring persons, particularly young children, in the vicinity thereof. The apparatus comprises a transverse front wall member and first and second side wall members attached on opposite ends of the front member respectively. In use, the apparatus is attached proximal to the front edge of a range or stove top with each sidewall member extending rearwardly and providing gripping surfaces engageable with confronting side surfaces of the range or stove top to which the apparatus is thusly attached. The front wall extends above the flat stove or range top surface a sufficient distance to deflect hot foods particles emitted during cooking from being projected outwardly beyond the front plane of the stove or range where if undeflected such splattering could cause burns or other injuries to persons in the vicinity of the cooking appliance. In an alternatively preferred embodiment, the side wall members are hinged to the front wall member and are foldable relative thereto to render the apparatus more compact when not in use and during storage.

13 Claims, 6 Drawing Sheets

FIG 9
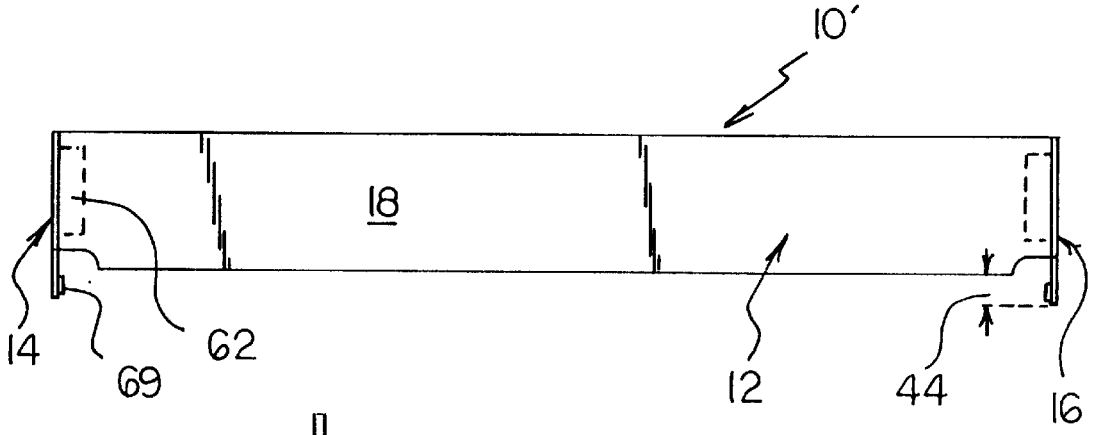
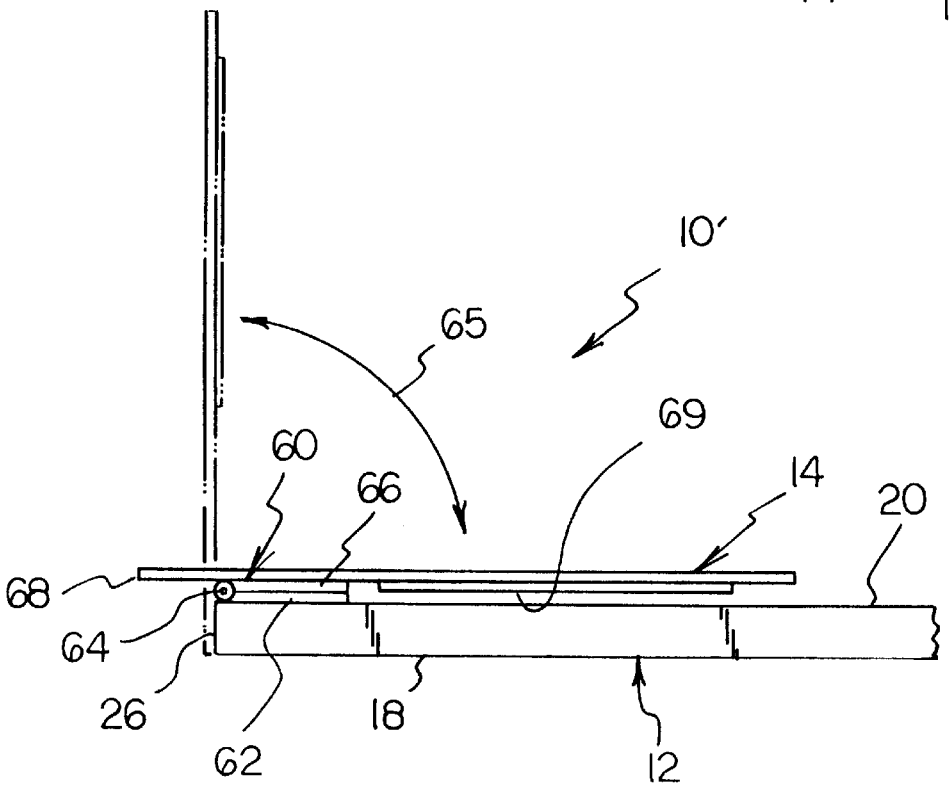
FIG 10

RANGE GUARD APPARATUS AND METHOD

RELATED APPLICATION

This application is a continuation-in-part of my prior application Ser. No. 29/022,370; filed May 4, 1994, which in turn, is a continuation of application Ser. No. 07/948,993; filed Sept. 21, 1992, now abandoned.

BACKGROUND OF THE INVENTION

1. Field of the Invention

The present invention relates generally to a method and apparatus for preventing burns or other injuries to persons standing in front of a hot stove or range top during cooking activities.

2. Description of the Prior Art

The use of devices for preventing burns or other injuries while working or standing in the vicinity of a hot stove or electric cooking range are generally known. More specifically, the following patents describe various devices for preventing burns from splattering grease, water food particles, and so on: U.S. Pat. Nos. 4,155,343; 4,314,543; 4,517,955; 4,836,181; and 4,934,333.

While these devices fulfill their respective, particular objectives and requirements, the aforementioned patents do not disclose nor suggest a range guard apparatus having the same combination of desirable features as the present invention, particularly with respect to advantages of compact size, flexible storage, low cost, ease of maintenance, attractiveness of appearance and other desirable characteristics.

In these respects, the method and apparatus according to the present invention substantially departs from the conventional concepts and designs of the prior art, and in so doing provides an important contribution to the art of safety devices in general, and to the art of devices for preventing injuries while in front of or near a hot stove or range top, in particular.

SUMMARY OF THE INVENTION

Briefly described, the present invention relates to a range guard apparatus for preventing hot food splashes from injuring persons, particularly young children, in the vicinity thereof. The apparatus comprises a transverse front wall member and first and second side wall members attached on opposite ends of the front member respectively. In use, the apparatus is attached proximal to the front edge of a range or stove top with each sidewall member extending rearwardly and providing gripping surfaces engageable with confronting side surfaces of the range or stove top to which the apparatus is thusly attached. The front wall extends above the flat stove or range top surface a sufficient distance to deflect hot foods particles emitted during cooking from being projected outwardly beyond the front plane of the stove or range where if undeflected such splattering could cause burns or other injuries to persons in the vicinity of the cooking appliance. In an alternatively preferred embodiment, the side wall members are hinged to the front wall member and are foldable relative thereto to render the apparatus more compact when not in use and during storage.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new method and apparatus for preventing burns or other injuries to persons in the vicinity of a hot stove or cooking range due to the splattering of heated food particles and which has many advantages and many novel features that are not anticipated, rendered obvious, suggested, or even implied by any of the prior art safety devices, either alone or in any combination thereof.

It is another object of the present invention to provide a new apparatus for preventing burns or other injuries to persons in the vicinity of a hot stove or cooking range due to the splattering of heated food particles which apparatus may be easily and efficiently manufactured and marketed.

It is a further object of the present invention to provide a new apparatus for preventing the splattering of heated food particles from a hot stove or other cooking range and thereby causing injuries to persons in the vicinity thereof which apparatus is of a durable and reliable construction.

Still another object of the present invention is to provide a new apparatus adapted for easy and simple attachment to a conventional stove or range top and when so attached prevents hot food particles from being spattered beyond the confines of the stove top.

Yet another object of the present invention is to provide a new apparatus for preventing hot food from splattering during cooking activities on a stove or range top and which occupies a minimum amount of space and does not unduly interfere with cooking activity.

Still yet another object of the present invention is to provide a range guard apparatus which because of its upstanding disposition transversely of the front edge of a cooking appliance, is extremely highly effective in eliminating the danger of splattered hot food particles impinging upon the face and head area of young children standing or otherwise positioned below and near the front edge of the range during cooking activity.

Still another object of the present invention is to provide a new apparatus for preventing food burns to individuals in the vicinity of a heated stove or range which apparatus has an attractive overall appearance.

Yet still another object of the present invention is to provide a new stove or range guard apparatus that is easy and inexpensive to maintain.

Still another object of the present invention is to provide a new range or stove guard apparatus that is adapted to be folded into a compact size for easy storage when not in use.

These together with other objects of the invention, along with the various features of novelty and construction which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is a front elevational view of the alternatively preferred embodiment of FIG. 8.

FIG. 10 is a top plan view of a portion of the alternatively preferred embodiment of FIG. 8.

DESCRIPTION OF THE PREFERRED EMBODIMENTS

Figure 1:
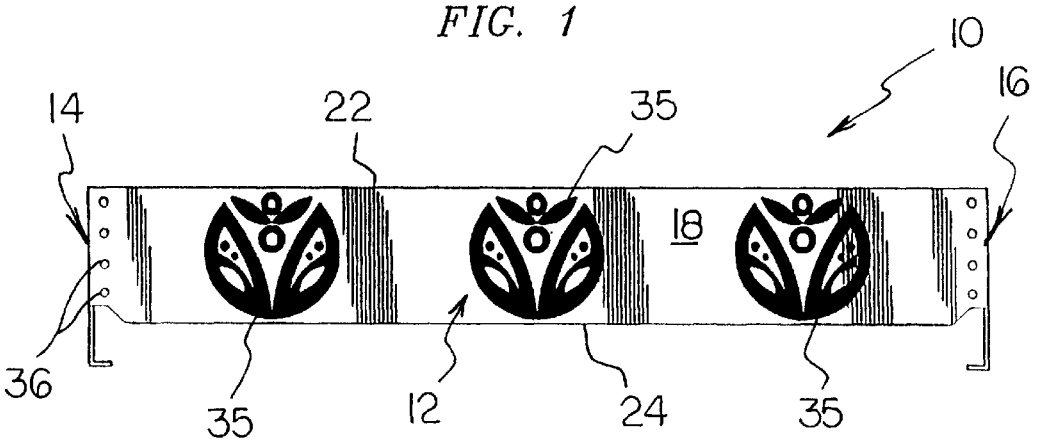
FIG. 1 is a front elevation view of a range guard apparatus according to the present invention.
Figure 2:
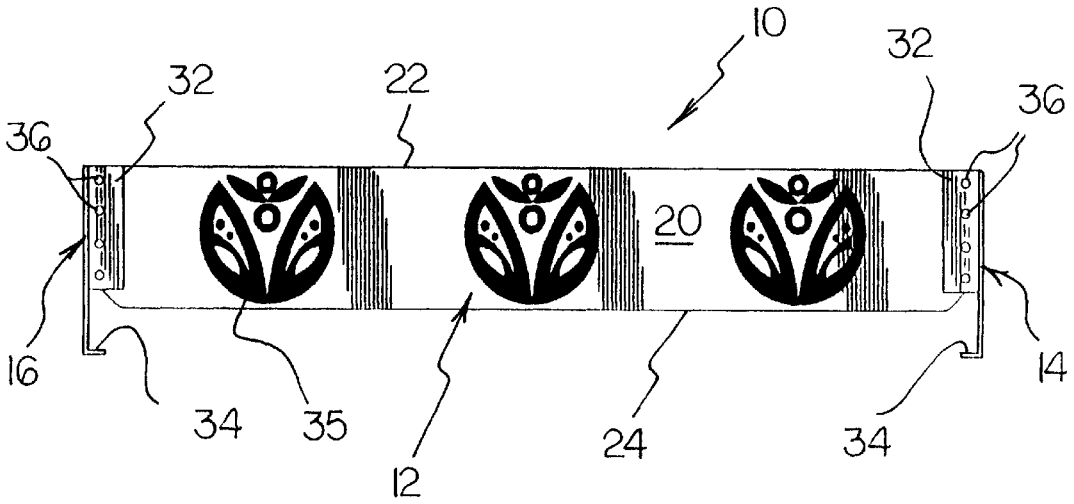
FIG. 2 is a rear elevation view of the present invention.
Figure 3:
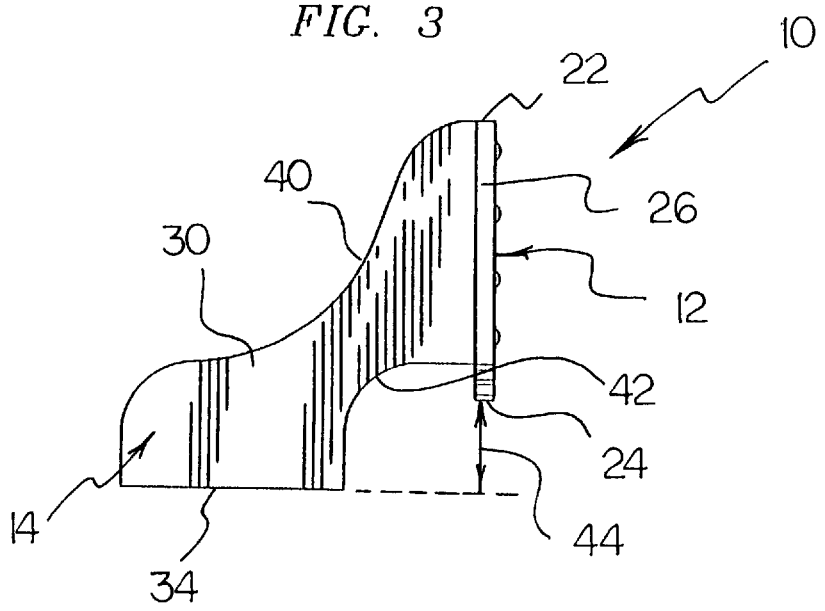
FIG. 3 is a left side elevation view of the invention.
Figure 4:
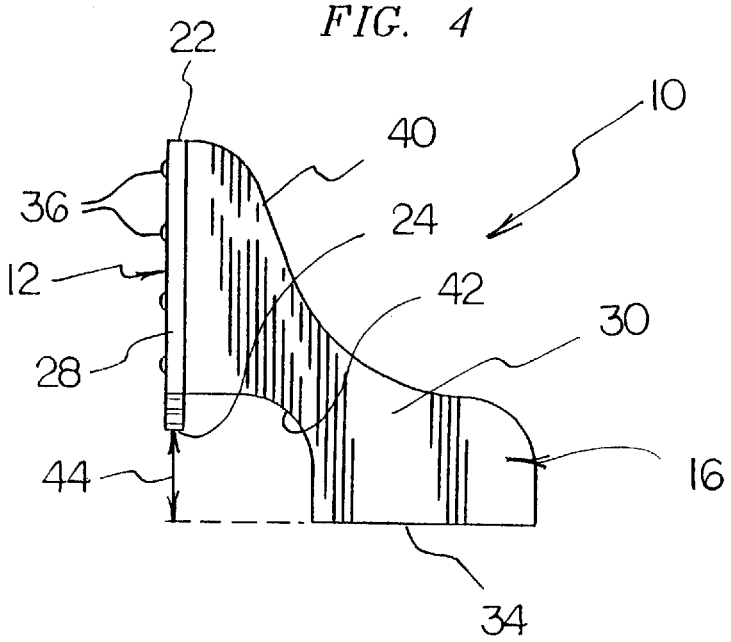
FIG. 4 is a right side elevation view of the invention.
Figure 5:
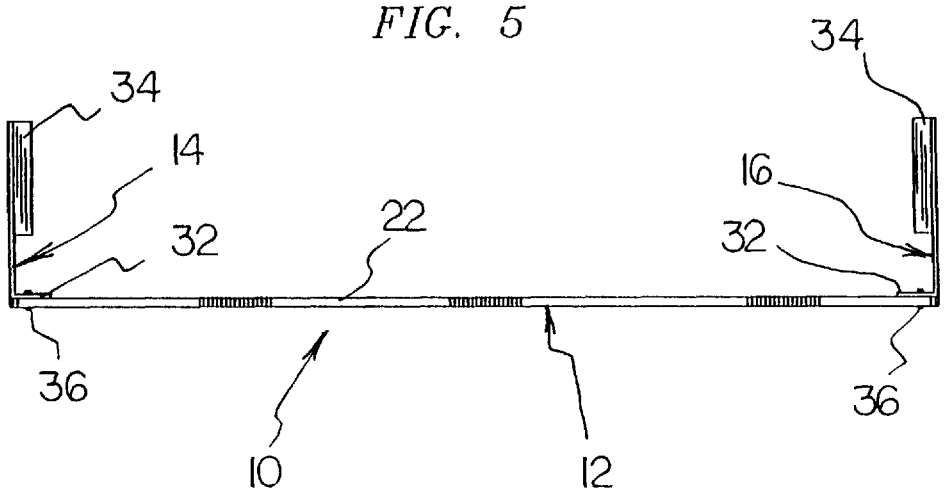
FIG. 5 is a top plan view of the invention.
Figure 6:
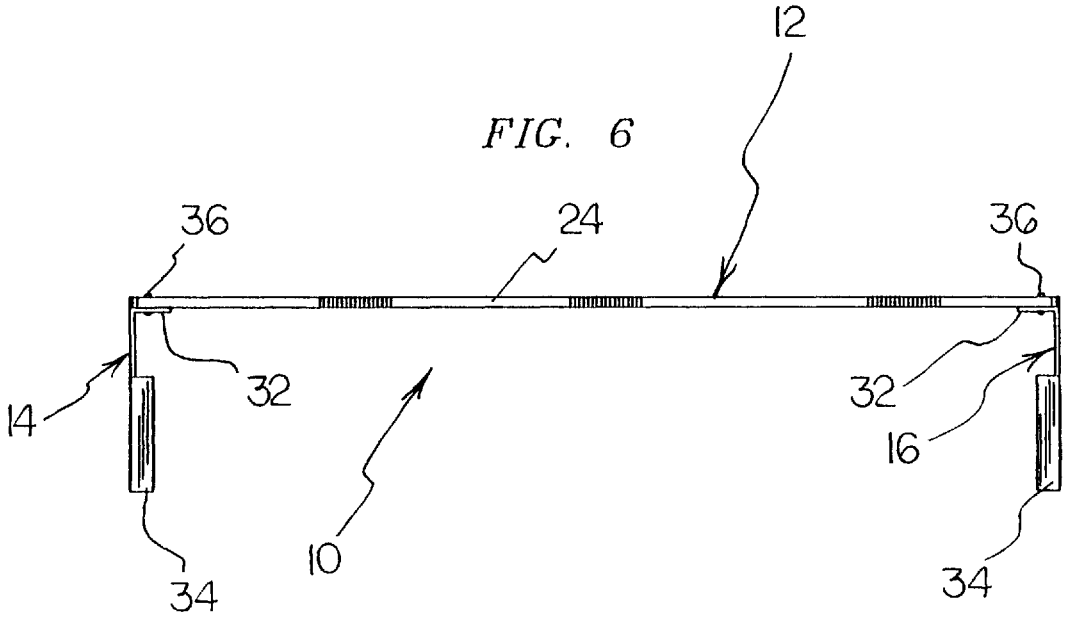
FIG. 6 is a bottom plan view of the invention.

With initial reference now to FIGS. 1–6 of the drawings, a first embodiment incorporating the principles and concepts of the present invention will be described.

More specifically, a range guard apparatus is provided generally represented by reference numeral 10 comprising a transverse front wall member 12, a first side wall member 14 connected to front wall at a first end thereof and second wall member 16 connected to front wall member 12 at an opposed second end thereof. Transverse front wall member 12 has a generally elongated rectangular configuration substantially as shown and includes a front face 18, an opposed rear face 20, a top edge 22, an opposed bottom edge 24, a first side edge 26, and a second opposed side edge 28, respectively.

First and second side wall members 14, 16 are identical to each other and thereof a description of one will suffice for the other. Thus, first side wall member 14 includes a central portion 30, a first laterally extending edge portion 32 and a second laterally extending edge portion 34. First edge portion 32 extends orthogonally with respect to central portion 30 and forms a rectangular flange or lip for connection to the rear face 20 of front wall member 12 proximal to the latter's first side edge 26 substantially as illustrated. The free edge (unlabeled) of flange 32 thus extends laterally inwardly toward opposed second side edge 28 of front wall member 12. A series of vertically spaced rivets or the like 36 extending orthogonally through the front wall member and the lateral flange 32 preferably are used to fasten these parts and therefore the side wall 14 and the front wall member 12 together in the manner shown. Graphical symbols 35 represent decorative surface indicia which may be applied to front face 18 and/or rear face 20 to give it a distinctive attractive appearance. Obviously, any other form of symbol, color, painting, artwork, or the like, may be placed on faces 18, 20 in lieu of graphical symbols 18, or placed on other exposed surfaces of range guard apparatus 10, as will obviously occur to those of ordinary skill and without departing from the invention.

Second edge portion 34 also defines a rectangular flange or lip extending laterally inwardly toward opposed second side edge 28 and orthogonally with respect to the central portion 30 of side wall member 14. However, it will be observed that the plane of second flange 34 is orthogonal with respect to the plane of first flange 32. Stated otherwise, in the context of FIGS. 3 and 4, first flange 32 is vertically oriented whereas second flange 34 is horizontally oriented. Central portion 30 extends between its intersection with first flange 32 and its intersection with second flange 34 and has a top curved surface 40 and a bottom curved surface 42 as viewed in FIGS. 3 and 4. It will be observed that the lower section of central portion 30 extends below and terminates beyond the bottom edge 24 of front wall member by a dimension 44 (see FIG. 3). In accordance with the present invention, this downwardly depending lower section of side wall 14 (and likewise of side wall 16) forms a portion for engaging a corresponding confronting side wall portion of a cooking stove or electric range when range guard apparatus 10 is placed on the top surface of the applicance proximal to the front edge thereof as will be explained in more detail below. More specifically, with respect to the preferred embodiment of FIGS. 1–6, the second flange 34 is adapted to be inserted within the seam existing between the top panel and the side panels on most conventional cooking appliances (i.e. electric or gas stoves) in use today and thereby serves to removably attach the range guard apparatus to the cooking appliance in its operative position with the front transverse panel extending across the front edge portion of the appliance in an upstanding manner.

Figure 7:
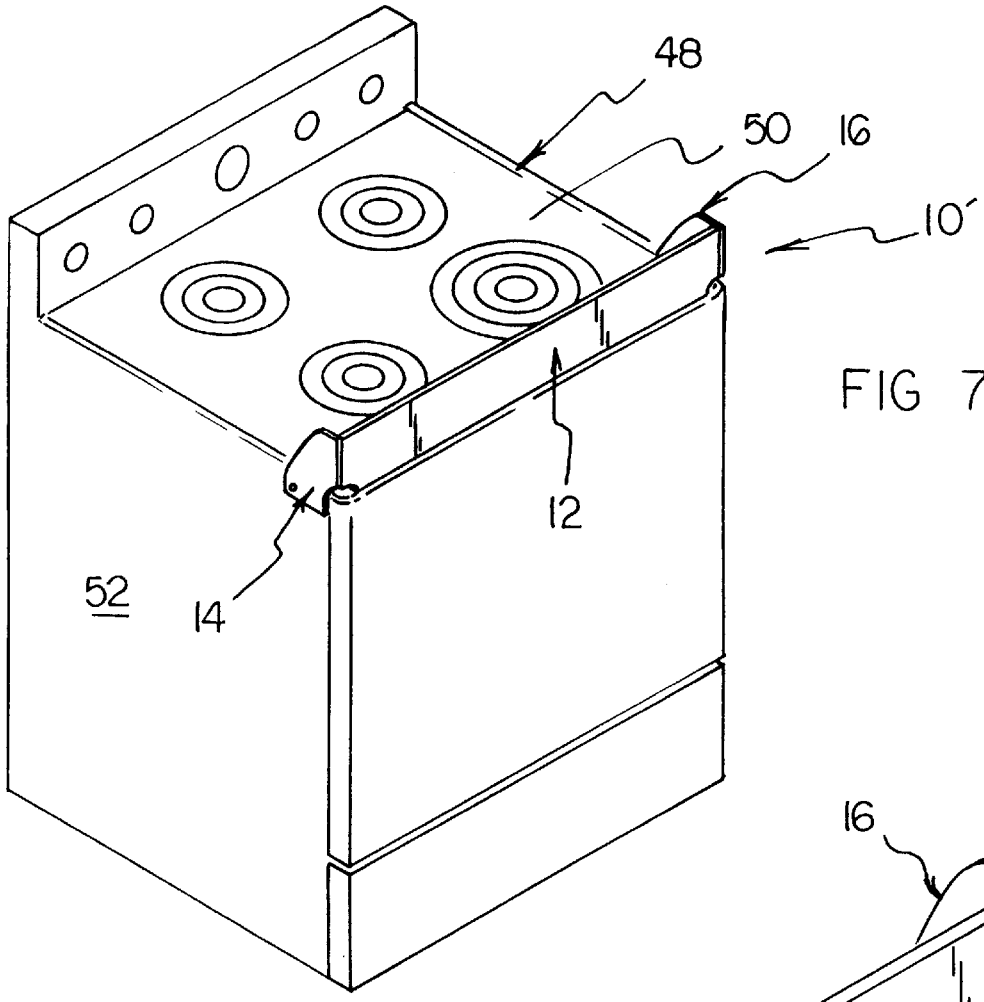
FIG. 7 is a perspective view of an alternatively preferred embodiment of the range guard apparatus installed in operative position on a conventional cooking appliance.

More specifically, and turning now to FIG. 7, there is diagrammatically depicted a second preferred embodiment of the range guard apparatus according to the invention, indicated by reference numeral 10', in operative position on a conventional electric cooking range generally indicated by reference numeral 48. In the following description, similar reference numerals are used to denote similar parts already described. It will be observed that front wall member 12 reposes transversely of the top surface 50 of the range proximal to the latter's front edge and extends substantially across the entire transverse extent of the stove top. It also will be noted that the lower section of side wall member 14 engages the confronting portion of the side wall 52 of range 48 to maintain the front wall portion 12 in the operative position as substantially shown in FIG. 7. Second side wall member 16 functions in an identical manner. In such operative position, it has been discovered that during cooking activity, most, if not all splattered (and heated) food particles generated during cooking activity are deflected rearwardly toward the cooking elements on the range top surface 50 by the rear surface 20 of the front wall member 12 and the inside surfaces (unlabeled) of the central portions of side wall members 14, 16. Hence, it will be appreciated that the range guard apparatus of the present invention is extremely effective in preventing injuries due to splattering of hot food particles during cooking activities to persons in the vicinity of range 48; and most particularly, to young children who by reason of their reduced height commonly stand, play or otherwise position themselves in front of a range or stove during cooking activity with their head and face area being located near and below the front edge of the cooking surface. The range guard apparatus of the present invention because of its upstanding disposition transversely of the front edge of the range 48 is therefore, extremely highly effective in eliminating the danger of splattered hot food particles impinging upon the face and head area of such young children so positioned below the front edge of the range during cooking activity.

In the second preferred embodiment of the range guard apparatus illustrated in FIGS. 7–10, each side wall member 14, 16 is attached to the front wall member 12 by means of corresponding hinge assembly 60 which permits the sidewall to be folded inwardly toward and against the rear face 20 as best seen in FIG. 10. Hinge assembly 60 includes a first hinge plate member 62, an axle or hinge pin 64 and a second hinge plate member 66. Each first hinge plate is attached to the surface 20 proximal to first or second side edges, respectively, in suitable manner as by spot welding, for example. Likewise, each second hinge plate 66 is attached to the inner surface (unlabeled) of first and second side wall members in a similar manner, as substantially shown in FIG. 10.

In its operative condition, hinge assembly 60 permits the side wall members to be folded outwardly to assume a perpendicular or orthogonal orientation with respect to front wall member 12, indicated by arrow 65, with this position being indicated by broken lines in FIG. 10. In its inoperative or storage condition, hinge assembly 60 permits the side wall members to be folded substantially flat to assume a parallel orientation with respect to front wall member 12. It will be appreciated that in the folded condition (FIG. 10), range guard apparatus 10' is in a very compact form adapted for easy storage in a closet, under a bed, and so on.

As shown most clearly in FIG. 10, the second hinge plate 66 is spaced inwardly from the front edge 68 of side wall member 14 thereof so that when the side wall member is in the unfolded condition (broken lines, FIG. 10), the front vertical portion of the sidewall abuts side edge 26 (and side edge 28) and front edge 68 coincides with and is aligned with the plane of front surface 20 of front wall member 12. This arrangement permits side edge 26 (or 28) to act as a stop or abutment for each side wall when it is unfolded to its operative condition, respectively, and prevents a nicely finished appearance to each opposed corner of the range guard apparatus 10'.

Figure 8:
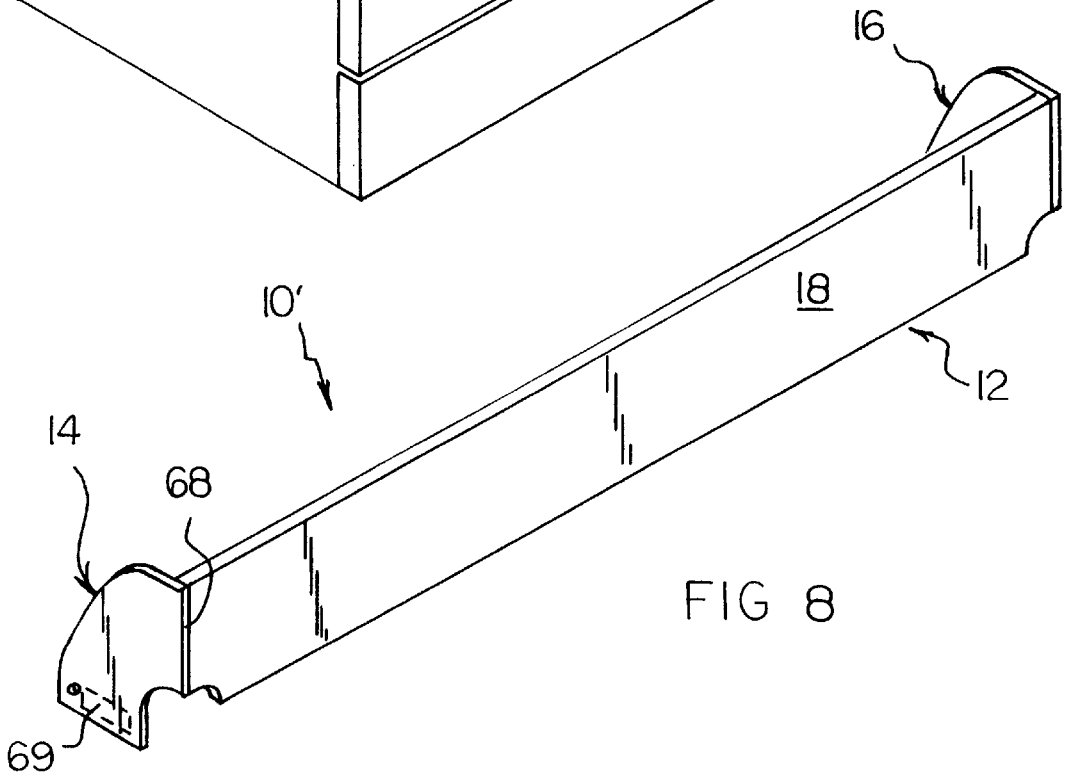
FIG. 8 is a perspective enlarged view of the alternatively preferred embodiment of FIG. 7.

The alternatively preferred embodiment of FIGS. 7–10 also dispenses with the second inwardly facing flange 34 (horizontal) in favor of a rectangular patch or element 69 of conventional hook or loop material such as made available commercially under the celebrated trademark VELCRO glued or otherwise fastened to the inside surface of the lower section of each sidewall central portion 30 substantially as shown in FIGS. 8–10. A similar complimentary fastener element (not labeled) may be fastened by adhesive or otherwise to a portion of the side wall of range 52 confronting the inside surface of each side wall central section lower section to matingly engage fastener element 69 when the apparatus is placed in its operative position on range 48 substantially as illustrated in FIG. 7. It will be appreciated that the use of VELCRO fastener elements in the manner indicated herein provides effective and convenient means for selectively attaching the side wall members to the cooking appliance it is used with and for firmly and securely supporting the side wall members and the front wall member in the operative position of FIG. 7.

Without limiting the present invention, and merely as illustration, in a typical range guard apparatus, the front wall member 12 may have a transverse longitudinal extent of 30.00 in., a height of 04.00 in. and a width or thickness of 00.25 in. Similarly, each side wall member 14 or 16 may have a transverse longitudinal extent of 05.00 in., a height of 05.00 in., a thickness of 00.062 inches, and a dimension 44 of 01.00 in.

Figure 11:
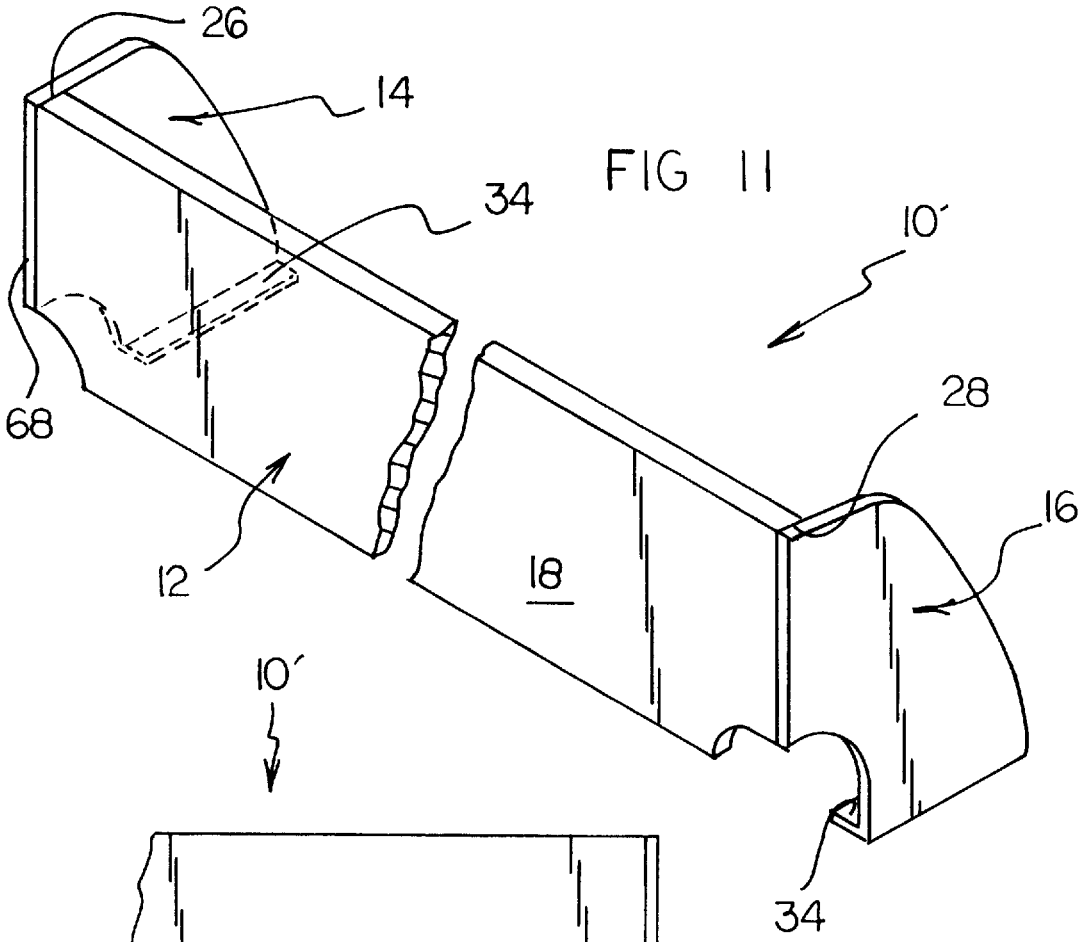
FIG. 11 is a perspective somewhat enlarged view of yet another alternatively preferred embodiment of the invention.
Figure 12:
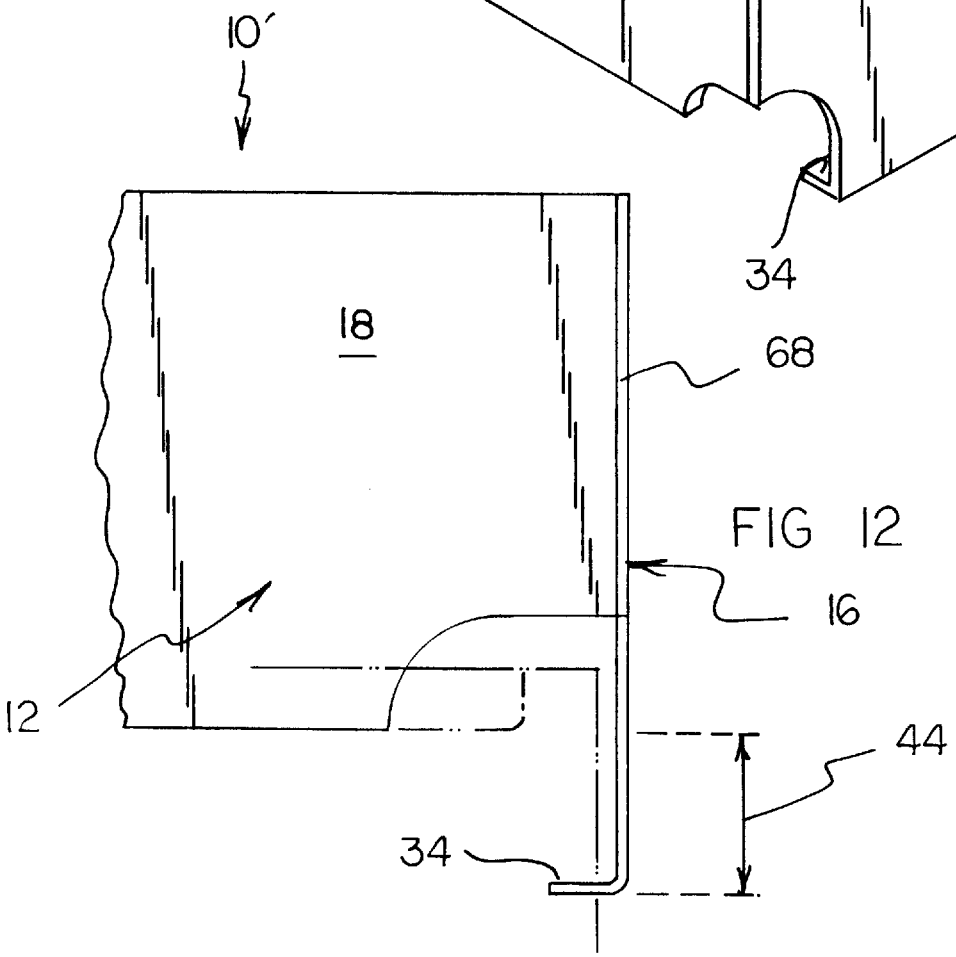
FIG. 12 is a front elevational view of a portion of the alternatively preferred embodiment of the present invention shown in FIG. 11.

If desired, in lieu of VELCRO fasteners 60, the laterally inwardly facing flange or lip 34 may be used with the range guard apparatus 10' as illustrated in FIGS. 11 and 12.

As to a further discussion of the manner of usage and operation of the present invention, the same should be apparent from the above description. Accordingly, no further discussion relating to the manner of usage and operation will be provided.

The range guard apparatus may be fabricated of wood, plastic, aluminum, other metal, or other durable materials.

With respect to the above detailed description, it is to be realized that all equivalent relationships to those illustrated in the drawings and described in the specification are intended to be encompassed by the present invention, and further, that the foregoing description is considered as illustrative only of the principles of the invention. Because numerous modifications and changes will readily occur to those skilled in the art, it is not desired to limit the invention to the exact construction and operation shown and described, and accordingly, all suitable modifications and equivalents may be resorted to, falling within the scope of the invention as defined only in the appended claims.

What is claimed as being new and desired to be protected by Letters Patent of the United States is as follows:

1. Apparatus for preventing splattering in the vicinity of a cooking appliance having a top surface with heating elements, said top surface being defined by at least a front edge and first and second side walls extending rearwardly with respect to said front edge, said apparatus comprising:

a front transverse wall member having opposed first and second ends, at least one side wall member connected to said front transverse member proximal to a first or second end thereof, said at least one side wall member having a portion for engaging a confronting side wall portion of said appliance when said transverse member is placed on said top surface proximal to said front edge thereof whereby splattering of food caused by cooking thereof on one or more of said heating elements is substantially deflected away from said front edge of said appliance by said transverse wall member and said at least one side wall member toward said heating elements, wherein said front transverse wall member includes a bottom edge extending longitudinally between said first and second ends thereof and said portion for engaging said confronting side wall portion of said appliance extends below said bottom edge, and wherein said at least one side wall member portion for engaging said confronting side wall portion of said appliance below said bottom edge of said transverse wall member terminates in a first edge distal with respect to said front transverse wall member and terminates in a second edge proximal to said front transverse wall member, said first distal edge being orthogonally oriented with respect to said second proximal edge, said second proximal edge being parallel to said first or second ends of said front transverse wall member.

2. The apparatus of claim 1 further including a second side wall member connected to said front transverse member proximal to a second end thereof.

3. The apparatus of claim 1 wherein said distal first edge is a flange extending orthogonally with respect to said at least one side wall member.

4. The apparatus of claim 3 further including a hook or loop fastener patch proximal to said first distal edge.

5. The apparatus of claim 4 further including a hinge assembly, said hinge assembly being connected between said at least one side wall member and said first or second ends of said front transverse wall member.

6. The apparatus of claim 4 wherein said hinge assembly includes a pivotal axle parallel to said first or second ends of said front transverse wall member whereby said at least one side wall member is adapted to be folded about said pivotal axle to a first condition where said at least one side wall member is parallel to said front transverse wall member and a second condition where said at least one side wall member is orthogonal to said front transverse wall member.

7. The apparatus of claim 4 wherein a portion of said at least one side wall member including said second proximal edge abuttingly engages said first or second end when said at least one side wall member is in said second condition.

8. The apparatus of claim 7 wherein said front transverse wall member further includes a first surface extending between said first and second ends, said first surface adapted to face away from say heating elements and a second opposed surface adapted to face in the direction of said heating elements, said second proximal edge being aligned with and co-planar with said first surface when said at least one side wall member is said second condition.

9. The apparatus of claim 8 wherein said front transverse wall member further includes a first surface extending between said first and second ends, said first surface adapted to face away from say heating elements and a second opposed surface adapted to face in the direction of said heating elements, at least said first surface having decorative surface indicia on a portion thereof.

10. The method of preventing splattering in the vicinity of a cooking appliance having a top surface with heating elements, said top surface being defined by at least a front edge and first and second side walls extending rearwardly with respect to said front edge, said apparatus comprising:

(a) providing the apparatus of claim 9, (b) placing said apparatus on said top surface between said front edge thereof and said heating elements such that said front transverse wall member deflects splattered heated food particles toward said heating elements, and (c) positioning said at least side wall member in position to engage said confronting side wall portion of said appliance.

11. The method of preventing splattering in the vicinity of a cooking appliance having a top surface with heating elements, said top surface being defined by at least a front edge and first and second side walls extending rearwardly with respect to said front edge, said apparatus comprising:

(a) providing the apparatus of claim 1, (b) placing a patch of hook or loop fastener material on said confronting side wall portion of said appliance, d) placing said apparatus on said top surface between said front edge thereof and said heating elements such that said front transverse wall member deflects splattered heated food particles toward said heating elements, and (e) positioning said at least one side wall member in position to engage said confronting side wall portion of said appliance in such a manner that said hook or loop fastener patch proximal to said first distal edge matingly engages said patch of hook or loop fastener material emplaced during step (b).

12. Apparatus for preventing splattering in the vicinity of a cooking appliance having a top surface with heating elements, said top surface being defined by at least a front edge and first and second side walls extending rearwardly with respect to said front edge, said apparatus comprising:

a front transverse wall member having opposed first and second ends, at least one side wall member connected to said front transverse member proximal to a first or second end thereof, said at least one side wall member having a portion for engaging a confronting side wall portion of said appliance when said transverse member is placed on said top surface proximal to said front edge thereof whereby splattering of food caused by cooking thereof on one or more of said heating elements is substantially deflected away from said front edge of said appliance by said transverse wall member and said at least one side wall member toward said heating elements, further including a hinge assembly, said hinge assembly being connected between said at least one side wall member and said first or second ends of said front transverse wall member for permitting said at least one side wall to selectively be oriented in a first operative position wherein said at least one side wall extends substantially orthogonally with respect to said side transverse wall member and a second inoperative position wherein said at least one side wall extends substantially parallel with respect to a portion of said transverse wall member.

13. The apparatus of claim 6 wherein said transverse wall member includes opposed first and second surfaces extending between said first and second ends thereof, said apparatus including a pair of said side wall members and a corresponding pair of said hinge assemblies such that when said pair of side wall members are oriented in their second inoperative position they repose in a longitudinally spaced manner intermediate of said first and second ends of said transverse wall member proximal to either said first surface or said second surface thereof.

* * * * *